United States Patent [19]

Mammarella, Sr.

[11] Patent Number: 4,672,893

[45] Date of Patent: Jun. 16, 1987

[54] FLEXO-GRAVURE PRINTING

[75] Inventor: James J. Mammarella, Sr., Hatfield, Pa.

[73] Assignee: Paramount Packaging, Chalfont, Pa.

[21] Appl. No.: 714,419

[22] Filed: Mar. 21, 1985

[51] Int. Cl.[4] ..... B41F 9/01; B41F 5/22

[52] U.S. Cl. ..... 101/170; 101/153; 101/217

[58] Field of Search ..... 101/150, 152, 154, 153, 101/170, 217, 218, 137, 375, 376, 377, 380, 216

[56] References Cited

U.S. PATENT DOCUMENTS

| | | | |
|---|---|---|---|
| 1,000,656 | 8/1911 | Wood | 101/401 X |
| 2,911,907 | 11/1959 | Davidson | 101/137 |
| 2,981,181 | 4/1961 | Levien | 101/217 |
| 3,163,108 | 12/1964 | Hornberger et al. | 101/154 |
| 3,431,847 | 3/1969 | Smith et al. | 101/226 X |
| 3,817,209 | 6/1974 | Zurick | 101/170 X |
| 3,889,596 | 6/1975 | Thomas et al. | 101/154 |
| 3,985,953 | 10/1976 | Dunkley | 101/170 X |
| 4,195,566 | 4/1980 | Ozawan et al. | 101/218 X |
| 4,403,547 | 9/1983 | Forberger | 101/70 |

*Primary Examiner*—J. Reed Fisher

*Attorney, Agent, or Firm*—Seidel, Gonda, Goldhammer & Abbott

[57] ABSTRACT

A hybrid printing process wherein an ink fountain cylinder is provided with a gravure image carrier portion and an anilox ink metering portion. A cylinder associated with the ink fountain cylinder is provided with a blanket transfer portion and a flexographic image carrier portion. The images carried by the gravure and flexographic portions are imprinted at one or more stations to create a total design on a flexible plastic substrate.

12 Claims, 5 Drawing Figures

FIG. 1
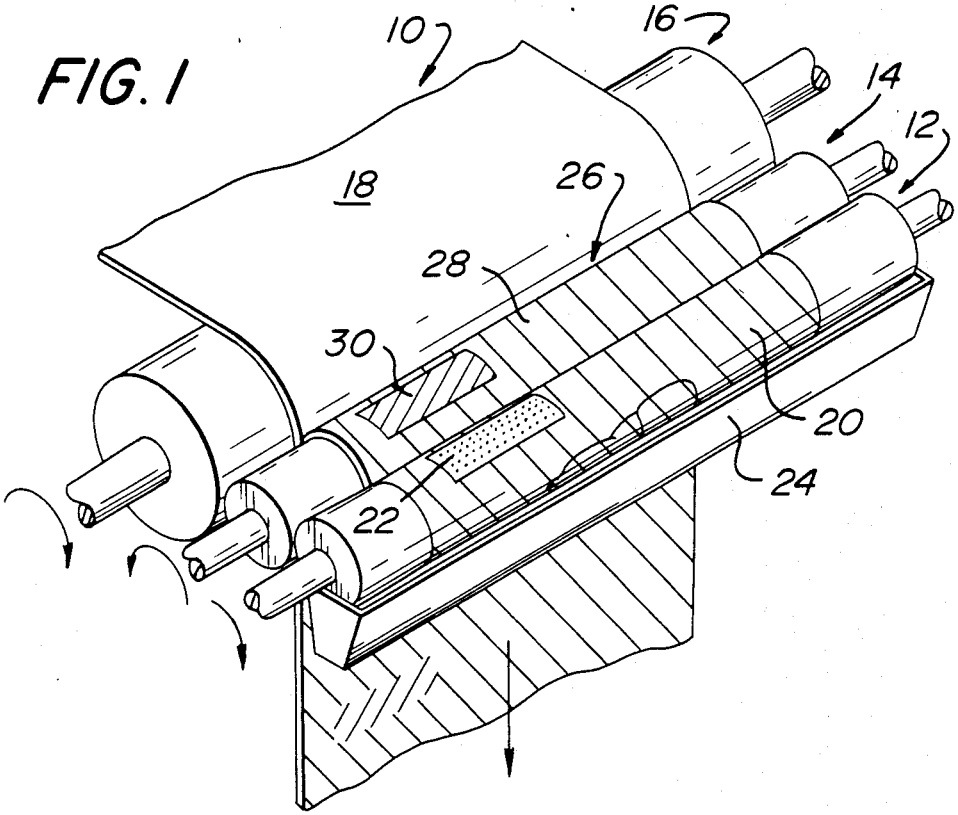
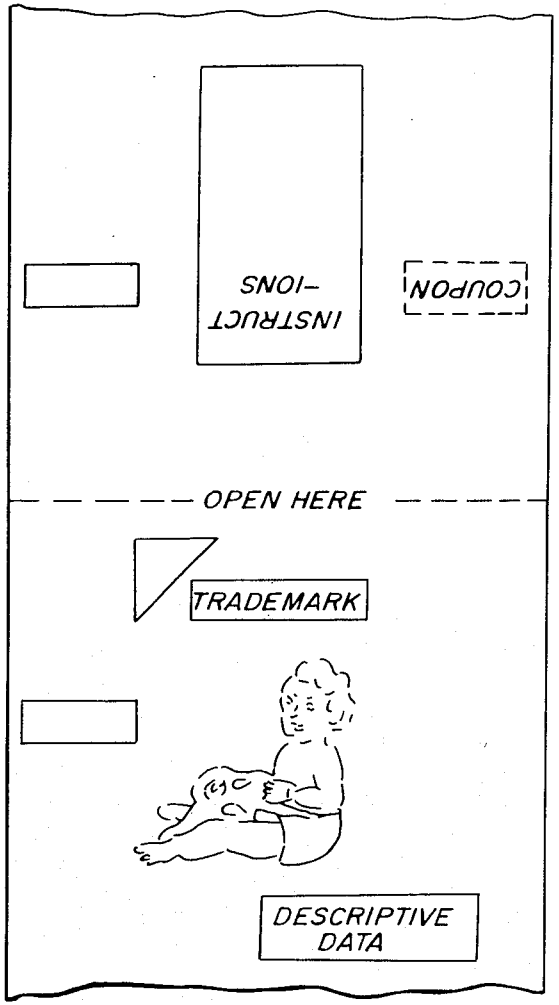
FIG. 2

FIG. 3
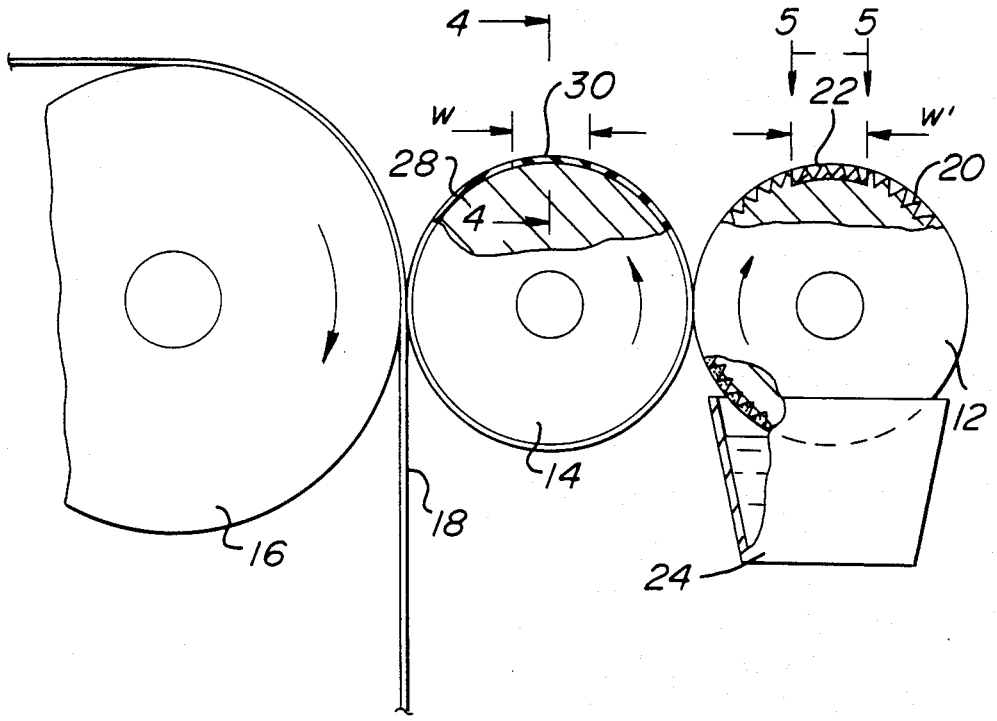
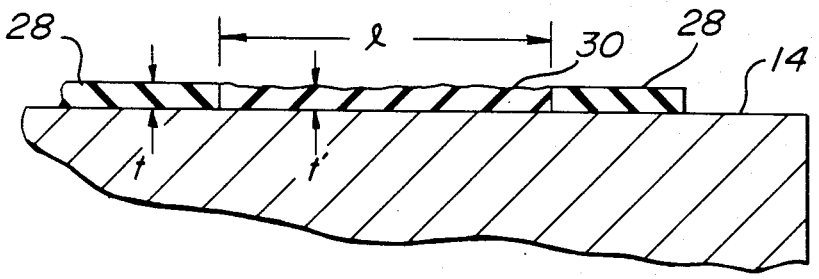
FIG. 4

FLEXO-GRAVURE PRINTING

BACKGROUND OF THE INVENTION

In gravure printing, a copper plated ink fountain cylinder is engraved to form an image in intaglio. The intaglio image is defined by cells or wells etched into the cylinder surface. Each cell is sized to contain a predetermined amount of ink. Ink is supplied to the cells by an ink fountain. As the cylinder rotates, the cells are flooded with ink and the surface between cells is wiped clean by a doctor blade. Ink is discharged from each cell and transferred to the smooth surface of an elastomeric blanket secured to a transfer cylinder. The blanket contacts a moving substrate such as a polyethelene film so as to transfer the inked image to the substrate.

Successive gravure stations may be operated in-line to form a multi-colored design comprising a vignette, line printing or any combination of the two. A vignette is a multicolored dot pattern which forms a facsimile of a transparency. Each station is supplied with its own ink fountain and transfer cylinders as well its own colored ink. The cells on an ink fountain cylinder are arranged in parallel lines. There is a predetermined number of lines per square inch depending on the fineness of the image. The line angle varies from one ink fountain cylinder to another to avoid objectionable visual effects in the inked image.

The flexographic printing process provides a simplified ink distribution system. In flexograph printing, an anilox or ink metering cylinder is etched mechanically with cells or wells using a knurled master cylinder. The metering cylinder is flooded with ink at the ink fountain. The cells are sized uniformly so that each contains a predetermined volume of ink. A metered amount of ink is accurately distributed by the cylinder to a flexographic printing plate mounted on a plate cylinder. The printing plate is made of an elastomeric material bearing an image in relief. Successive flexographic stations may be operated to form a design comprising a vignette, or line printing, or combination of both. Ink is deposited on the printing plate at each station by the metering cylinder, and the image is printed on the substrate by the printing plate.

In both the gravure and flexographic processes, a change in any portion of the substrate design requires replacement of an entire ink fountain cylinder or series of cylinders or an entire flexographic printing plate or series of printing plates.

The problem solved by the present invention is that of providing a quick and inexpensive way to change a specific vignette or line portion of a substrate design without having to replace an entire cylinder or printing plate, and without changing the remaining portions of the design.

BRIEF SUMMARY OF THE INVENTION

Flexo-gravure method of printing comprising providing a first, ink fountain cylinder having ink receiving cells on its periphery, certain of said cells defining an image carrier portion of the cylinder and other of said cells defining an ink metering portion of the cylinder, supplying ink to said cells, providing a second cylinder having an image carrier portion and a blanket transfer portion, transferring ink from said ink metering cells to said second cylinder image carrier portion and from said image carrier cells to said second cylinder blanket transfer portion, and transferring ink from said second cylinder image carrier and blanket transfer portions to a moving substrate.

For the purpose of illustrating the invention, there is shown in the drawings a form which is presently preferred; it being understood, however, that this invention is not limited to the precise arrangements and instrumentalities shown.

BRIEF DESCRIPTION OF THE DRAWINGS

FIG. 1 is perspective of a single printing press station in practicing the flexo-gravure process of the present invention.

FIG. 2 is a layout of a substrate imprinted with a design by the flexo-gravure process.

FIG. 3 is an elevation and partial section of the printing station shown in FIG. 1.

FIG. 4 is a partial section taken along 4—4 in FIG. 3.

DETAILS DESCRIPTION OF THE INVENTION

Figure 5:
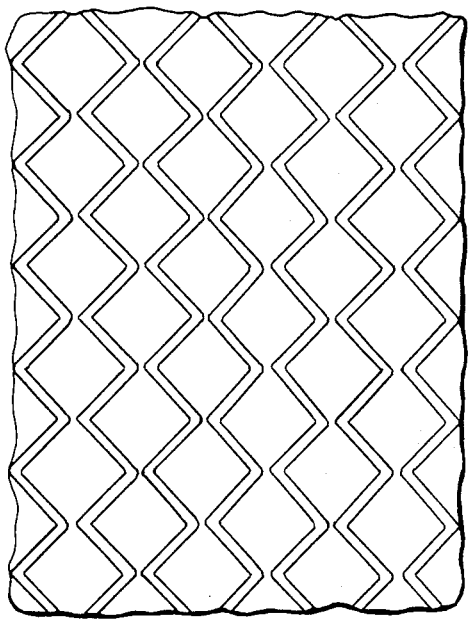
FIG. 5 is a view taken along 5—5 in FIG. 3.

Referring to the drawings, wherein like numerals indicate like elements, there is shown in FIG. 1 a printing station 10 in accordance with the present invention, it being understood that a series of such stations would normally be employed to create the desired substrate design. The printing station includes an ink fountain cylinder 12, cylinder 14 and impression cylinder 16. A moving web or substrate 18 is driven downwardly between cylinders 14, 16 as the cylinders rotate in opposite directions as indicated by arrows in FIG. 1.

Ink fountain cylinder 12 is fabricated from a conventional metal cylinder. The surface of cylinder 12 is etched to form a gravure image carrier portion 20 and an anilox ink metering portion 22. The gravure portion is mechanically etched by a stylus under computer control to form a plurality of cells or wells which define an image in intaglio. The image may be used to form a vignette or to form line printing but in most instances will be used to form a vignette. The anilox portion 22 is etched differently but by the same computerized technique to form a plurality of uniformly sized cells which perform an ink metering function. The cells of anilox portion 22 do not define an image. Cylinder 12 is partially submerged in an ink fountain or trough 24 which carries an ink of the desired color, wetness and viscosity for printing on substrate 18.

An elastomeric material 26 is wrapped on the surface of cylinder 14 to define the work surface of the cylinder. The elastomeric material comprises a blanket transfer portion 28 having a substantially smooth surface and a flexographic image carrier portion 30 provided with an image in relief. The image may be used to form a vignette or to form line printing but in most instances will be used to form line printing. The area of blanket transfer portion 28 matches that of gravure portion 20. The area of flexographic image carrier portion 30 matches that of anilox ink metering portion 22. Flexographic image carrier portion 30 and anilox ink metering portion 22 are of like widths w, w' and lengths 1, 1'. See FIG. 3. Cylinders 12, 14 are initially positioned during the makeready so that, as the cylinders rotate in opposite directions about their longitudinal axes, the flexographic and anilox portions 30, 22 move into and out of registration.

Blanket and flexographic portions 28, 30 are preferably made of a vinyl rubber material and are removably attached to cylinder 14 by double backed adhesive or sticky back. For this purpose, blanket portion 28 may be mounted on cushion sticky back and flexographic portion 30 may be mounted on hard sticky back. The thickness of flexographic portion 30 is preferably less than the thickness of blanket portion 28 as described more fully hereafter.

The web or substrate 18 may be a flexible plastic film such as polyethelene or it may be a paper or other web capable of receiving a printed pattern or design. The web is driven in conventional manner through the nip at cylinders 14, 16 to the next print station where the next colored ink is applied. At each print station, the cylinders 12, 14, 16 are journaled and driven by suitable conventional techniques so that the cylinders rotate about their longitudinal axes to repetitively print a pattern on moving web 18. The line angle on both the gravure and anilox portions of the ink fountain cylinders changes from station to station to avoid objectionable visual effects in the substrate design.

As cylinder 12 rotates, ink from fountain 24 floods the image carrier and ink metering cells in gravure and anilox portions 20, 22. Since anilox portion 22 performs an ink metering function while gravure portion 20 functions as an image carrier, the cell sizes and configurations for the anilox and gravure portions will differ. The image carrier cells in gravure portion 20 are sized and configured so as to provide the desired image. The ink metering cells in anilox portion 22 are sized and configured so as to provide the desired ink metering function. The ink metering function is matched to the type of ink being applied at the station. The following stock cell configurations and sizes have been used for the anilox portion of the ink fountain cylinder at each station of a three station press: 95 angle 0 and 0.484 milliliters (ml)/cell, 70 angle 4 and 0.389 ml/cell and 80 angle 4 and 0.324 ml/cell. The 95 angle 0 configuration is shown in FIG. 5.

The fineness of the image defined by gravure portion 20 depends on the line screen number (lines per square inch) for the gravure portion. A 180 line screen has been used for the gravure portion. The amount of ink transferred to flexographic portion 30 depends in part on the line screen number for the anilox portion. A 120 line screen has been used for the anilox portion.

The thicknesses t, t′ of the flexographic and blanket portions 30, 28 are chosen so that the cylinders 12, 14, 16 can be gauged in during makeready to ensure positive image transfer from flexographic portion 30 to substrate 18 without any gain in the size of the ink dots formed on the substrate by blanket portion 28. The thickness t′ of the flexographic portion, measured from the outermost relief surface to the cylinder surface, is preferably 0.002 inch less than the thickness t of blank portion 28. See FIG. 4. During makeready, cylinder 14 is positioned relative to impression cylinder 16 such that a "kiss" impression is provided between blanket portion 28 and substrate 18. Cylinder 14 is then moved 0.002 inch closer to cylinder 16 so as to "crush" or compress blanket portion 28 while providing a "kiss" impression between the substrate and the relief surface of flexographic portion 30.

A substrate 18 bearing a design comprising a vignette and line printing formed by the present invention is shown in FIG. 2. The portion(s) of the design which are not expected to change, such as the vignette 32 of a toddler, are carried by gravure image carrier portion(s) 20 of ink fountain cylinder(s) 12. These images are transferred by blanket portion(s) 28 of cylinder(s) 14 to the substrate. The portion(s) of the substrate design which are expected to vary, such as line print portions 34, 36, 38 and 40 which bear trademark, descriptive data, instructions and a coupon, are carried by flexographic portion(s) 30 (only one of which is shown in FIG. 1) which are removably attached to cylinder(s) 14. Matching anilox portion(s) 22 (only one of which is shown in FIG. 1) are etched on cylinder(s) 12. The cell size and configuration may vary from one anilox portion to the other on the same cylinder depending on the ink metering function to be performed by each portion.

Once a cylinder 12 is etched to form gravure and anilox portions 20, 22, no modifications of the cylinder are required to change the substrate design. The images in substrate portions 34–40 are simply changed by changing the corresponding flexograhic portion(s) on 30 on cylinder(s) 14. Each portion 30 may be quickly removed from the cylinder and replaced by a new portion bearing the new image. The change is simple to make and inexpensive. It constitutes a drastic reduction in cost as compared with the conventional technique of replacing an entire cylinder. The typical savings realized by the invention are $20,000 or more.

The present invention may be embodied in other specific forms without departing from the spirit or essential attributes thereof and, accordingly, reference should be made to the appended claims, rather than to the foregoing specification, as indicating the scope of the invention.

I claim:

1. Method of printing a moving substrate, comprising providing a first cylinder having ink receiving cells on its periphery, some of said cells defining an image carrier portion for gravure printing and other of said cells defining an ink metering portion for flexographic printing, supplying ink to said ink receiving cells, providing a second cylinder having a blanket transfer portion for gravure printing and a separate image carrier portion for flexographic printing, transferring ink from said image carrier cells to said second cylinder blanket transfer portion and from said ink metering cells to said second cylinder image carrier portion, and transferring ink from said second cylinder image carrier and blanket transfer portions to a moving substrate.

2. Method according to claim 1 including removably attaching said image carrier portion to the second cylinder.

3. Method according to claim 1 including completing a multi-colored design on the substrate at successive printing stations using different colored inks.

4. Method according to claim 3 including arranging the image carrier cells in parallel lines on the first cylinder at each printing station such that the lines of image carrier cells at successive stations are disposed at different angles.

5. Method according to claim 1 wherein said substrate is made of a flexible material.

6. Method according to claim 1 wherein the image defined by said image carrier cells is a vignette image.

7. Method according to claim 1 wherein the image defined by said second cylinder image carrier portion comprises line printing.

8. Printing apparatus comprising a first cylinder provided with ink receiving cells on its periphery, some of said cells being arranged so as to form an image carrier portion for gravure printing and other of said cells being arranged to form an ink metering portion for flexographic printing, a second cylinder having a blanket transfer portion for gravure printing in juxtaposition with the image carrier cells of the first cylinder and a separate image carrier portion for flexographic printing in juxtaposition with the ink metering cells of the first cylinder.

9. Printing apparatus according to claim 8 including an ink fountain for supplying ink to said ink receiving cells.

10. Printing apparatus according to claim 8 wherein the thickness of said second cylinder image carrier portion is 0.002 inch less than the thickness of said blanket portion.

11. Printing apparatus according to claim 8 wherein said second cylinder image carrier portion is secured to said second cylinder by sticky back and said blanket portion is secured to said second cylinder by sticky back.

12. Printing apparatus according to claim 8 wherein said image carrier portion is removably attached to said second cylinder.

* * * * *